US011779854B1

(12) United States Patent
Fleischhacker

(10) Patent No.: US 11,779,854 B1
(45) Date of Patent: Oct. 10, 2023

(54) UNDERWATER RETRIEVAL GAME METHOD EMPLOYING A SUBMERSIBLE TARGET

(71) Applicant: Adam Fleischhacker, Elkton, MD (US)

(72) Inventor: Adam Fleischhacker, Elkton, MD (US)

(73) Assignee: Fleischhacker Fix LLC, Elkton, MD (US)

( * ) Notice: Subject to any disclaimer, the term of this patent is extended or adjusted under 35 U.S.C. 154(b) by 13 days.

(21) Appl. No.: 17/589,452

(22) Filed: Jan. 31, 2022

Related U.S. Application Data

(60) Provisional application No. 63/144,327, filed on Feb. 1, 2021.

(51) Int. Cl.

| | |
|---|---|
| ***A63H 23/10*** | (2006.01) |
| ***A63B 67/00*** | (2006.01) |
| ***A63H 33/26*** | (2006.01) |
| ***A63H 33/22*** | (2006.01) |

(52) U.S. Cl.
CPC ..... *A63H 23/10* (2013.01); *A63B 67/007* (2013.01); *A63H 33/22* (2013.01); *A63H 33/26* (2013.01)

(58) Field of Classification Search
CPC .. A63H 23/10; A63B 2244/203; A63B 67/007
See application file for complete search history.

(56) References Cited

U.S. PATENT DOCUMENTS 1,675,522 A 7/1928 Weiidinger et al.
3,499,647 A 3/1970 Nestler
3,707,289 A 12/1972 Wicks
4,050,697 A 9/1977 Purviance
5,538,456 A * 7/1996 Liu ..... A63H 37/00 473/577
5,810,364 A * 9/1998 Canion ..... A63B 67/007 273/447
5,903,212 A * 5/1999 Rodgers ..... H05B 47/10 340/309.3
6,165,036 A 12/2000 Hino et al.
6,220,599 B1 * 4/2001 Eisch ..... A63B 67/007 446/153
6,332,822 B2 * 12/2001 Greenberg ..... A63B 69/12 446/153
6,699,535 B2 3/2004 Boschert
7,017,912 B2 3/2006 Chiang
(Continued)

*Primary Examiner* — Eugene L Kim
*Assistant Examiner* — Alyssa M Hylinski
(74) *Attorney, Agent, or Firm* — Invention To Patent Services; Alex Hobson

(57) ABSTRACT

An underwater retrieval game system employs a submersible target having a combination of features that make it difficult to locate underwater. The body portion of the submersible target is translucent and has a density greater than water. The target may be tossed in a swimming pool and sink to the bottom. A game player may jump into the water and try to locate the target. A combination of additional features such as size, shape, and surface texture may make it more difficult to spot the target underwater. A submersible target may comprise a detection device, such as a small light, that is activated after a certain period of time or is activated remotely by a wireless signal. A game player may be challenged to find the targets before the detection device is activated, for example.

17 Claims, 4 Drawing Sheets

(56) References Cited

U.S. PATENT DOCUMENTS

| | | | | |
|---|---|---|---|---|
| 7,234,703 | B1 * | 6/2007 | Kusz | A63H 23/08 446/153 |
| 7,278,637 | B2 | 10/2007 | Huebl et al. | |
| 9,078,415 | B2 | 7/2015 | Axelrod et al. | |
| 9,630,118 | B2 | 4/2017 | Wong et al. | |
| 2004/0092201 | A1 * | 5/2004 | Schoonmaker | A63H 23/10 446/153 |
| 2007/0281806 | A1 * | 12/2007 | Wong | A63B 31/00 446/153 |
| 2011/0014845 | A1 | 1/2011 | Monahan et al. | |
| 2014/0148077 | A1 * | 5/2014 | Hunter | A63H 23/10 446/153 |
| 2016/0121231 | A1 * | 5/2016 | Wong | A63H 23/08 446/153 |
| 2017/0100653 | A1 * | 4/2017 | Melman | A63B 67/007 |
| 2017/0100678 | A1 * | 4/2017 | Larson | A63B 41/00 |
| 2020/0292158 | A1 | 9/2020 | Fuller et al. | |

* cited by examiner

UNDERWATER RETRIEVAL GAME METHOD EMPLOYING A SUBMERSIBLE TARGET

CROSS REFERENCE TO RELATED APPLICATIONS

This application claims the benefit of priority to U.S. provisional patent application No. 63/144,327, filed on Feb. 1, 2021; the entirety of which is hereby incorporated by reference herein.

BACKGROUND OF THE INVENTION

Field of the Invention

The invention relates an underwater retrieval game system employing a submersible target.

Background

Many people enjoy time spent with family and friends around a swimming pool. Kids and some adults enjoy diving in the pool and searching for and retrieving items tossed into the pool. How long it takes and/or how many items are retrieved may be bragging points or the factors of a home-made game. Most targets are really easy to find quickly however as they are easily detected from the pool surface. Also, many objects project a shadow and these shadows, which are regular shapes, make it even easier to find the targets.

SUMMARY OF THE INVENTION

The invention is directed to an underwater retrieval game system employing a submersible target having a combination of features that make it difficult to locate underwater. An exemplary submersible target is substantially transparent in water being made of a material or combination of materials having an index of refraction of no more than 1.5 and no less than 1.2. In addition, an exemplary submersible target has a density greater than water so that it will sink. The target may be tossed in a swimming pool and sink to the bottom. A game player may jump into the water and try to locate the target. A submersible target may comprise a detection device, such as a small light, that is activated after a certain period of time or is activated remotely by a wireless signal. A game player may be challenged to find the target or targets before the detection device is activated, for example. In addition to transparency, an exemplary submersible target may have a rough surface, a shape with non-linear edges, a discontinuous outer surface, and a size to make it and shadows produced by the submersible target more difficult to see by an observer from above the surface of the water or when underwater.

An exemplary submersible target may be made out of a material that visually blends in with water and is hard to distinguish from the pool bottom. The target may have an index of refraction of no more than about 1.52 and preferably about 1.51 or less, and even more preferably about 1.5 or less, and about 1.2 or more, wherein the index of refraction of water is 1.33. Put another way, the submersible target may have an index of refraction that is substantially the same as water, or within about 0.20 the index of refraction of water (1.13 to 1.53). The closer the refractive index of the submersible target to that of the water it is submerged in, the more difficult it will be to locate.

The submersible target may be made out of a polymeric material and may be elastomeric. An elastomeric material is a material that can be deformed and then recover substantially to an original undeformed shape upon removal of a deforming force. An example of an elastomeric material is silicone and some urethane materials. An exemplary submersible target comprises silicone or polydimethylsiloxane which is an elastomer or elastomeric material.

The polymers listed in Table 1 have an index of refraction, or refractive index that is substantially the same as water such that they would be substantially transparent in water.

TABLE 1

| Polymer | Refractive Index |
|---|---|
| Dimethyl silicone rubber | 1.4 |
| Methyl phenyl silicone rubber | 1.40-1.60 |
| Poly(hexafluoropropylene oxide) | 1.301 |
| Poly(tetrafluoroethylene-co-hexafluoropropylene) | 1.338 |
| Poly(pentadecafluorooctyl acrylate) | 1.339 |
| Poly(tetrafluoro-3-(heptafluoropropoxy)propyl acrylate) | 1.346 |
| Poly(tetrafluoro-3-(pentafluoroethoxy)propyl acrylate) | 1.348 |
| Poly(tetrafluoroethylene) | 1.35 |
| Poly(undecafluorohexyl acrylate) | 1.356 |
| Poly(nonafluoropentyl acrylate) | 1.36 |
| Poly(tetrafluoro-3-(trifluoromethoxy)propyl acrylate) | 1.36 |
| Poly(pentafluorovinyl propionate) | 1.364 |
| Poly(heptafluorobutyl acrylate) | 1.367 |
| Poly(trifluorovinyl acetate) | 1.375 |
| Poly(octafluoropentyl acrylate) | 1.38 |
| Poly(methyl 3,3,3-trifluoropropyl siloxane) | 1.383 |
| Poly(pentafluoropropyl acrylate) | 1.385 |
| Poly(2-heptafluorobutoxy)ethyl acrylate) | 1.39 |
| Poly(chlorotrifluoroethylene) | 1.39 |
| Poly(2,2,3,4,4-hexafluorobutyl acrylate) | 1.392 |
| Poly(methyl hydro siloxane) | 1.397 |
| Poly (methacrylic acid), sodium salt | 1.401 |
| Poly(dimethyl siloxane) | 1.4035 |
| Poly(trifluoroethyl acrylate) | 1.407 |
| Poly(2-(1,1,2,2-tetrafluoroethoxy)ethyl acrylate | 1.412 |
| Poly(trifluoroisopropyl methacrylate) | 1.4177 |
| Poly(2,2,2-trifluoro-1-methylethyl methacrylate) | 1.4185 |
| Poly(2-trifluoroethoxyethyl acrylate) | 1.419 |
| Poly(vinylidene fluoride) | 1.42 |
| Poly(trifluoroethyl methacrylate) | 1.437 |
| Poly(methyl octadecyl siloxane) | 1.443 |
| Poly(methyl hexyl siloxane) | 1.443 |
| Poly(methyl octyl siloxane) | 1.445 |
| Poly(isobutyl methacrylate) | 1.447 |
| Poly(vinyl isobutyl ether) | 1.4507 |
| Poly(methyl hexadecyl siloxane) | 1.451 |
| Poly(ethylene oxide) | 1.4539 |
| Poly(vinyl ethyl ether) | 1.454 |
| Poly(methyl tetradecyl siloxane) | 1.455 |
| Poly(ethylene glycol mono-methyl ether) | 1.4555 |
| Poly(vinyl n-butyl ether) | 1.4563 |
| Poly(propylene oxide) | 1.457 |
| Poly(3-butoxypropylene oxide) | 1.458 |
| Poly(3-hexoxypropylene oxide) | 1.459 |
| Poly(ethylene glycol) | 1.459 |
| Poly(vinyl n-pentyl ether) | 1.459 |
| Poly(vinyl n-hexyl ether) | 1.4591 |
| Poly(4-fluoro-2-trifluoromethylstyrene) | 1.46 |
| Poly(vinyl octyl ether) | 1.4613 |
| Poly(vinyl n-octyl acrylate) | 1.4613 |
| Poly(vinyl 2-ethylhexyl ether) | 1.4626 |
| Poly(vinyl n-decyl ether) | 1.4628 |
| Poly(2-methoxyethyl acrylate) | 1.463 |
| Poly(acryloxypropyl methyl siloxane) | 1.463 |
| Poly(4-methyl-1-pentene) | 1.463 |
| Poly(3-methoxypropylene oxide) | 1.463 |
| Poly(t-butyl methacrylate) | 1.4638 |
| Poly(vinyl n-dodecyl ether) | 1.464 |
| Poly(3-ethoxypropyl acrylate) | 1.465 |

TABLE 1-continued

| Polymer | Refractive Index |
|---|---|
| Poly(vinyl propionate) | 1.4664 |
| Poly(vinyl acetate) | 1.4665 |
| Poly(vinyl propionate) | 1.4665 |
| Poly(vinyl methyl ether) | 1.467 |
| Poly(ethyl acrylate) | 1.4685 |
| Poly(vinyl methyl ether) (isotactic) | 1.47 |
| Poly(3-methoxypropyl acrylate) | 1.471 |
| Poly(1-octadecene) | 1.471 |
| Poly(2-ethoxyethyl acrylate) | 1.471 |
| Poly(isopropyl acrylate) | 1.4728 |
| Poly(1-decene) | 1.473 |
| Poly(propylene) (atactic) | 1.4735 |
| Poly(lauryl methacrylate) | 1.474 |
| Poly(vinyl sec-butyl ether) (isotactic) | 1.474 |
| Poly(n-butyl acrylate) | 1.474 |
| Poly(dodecyl methacrylate) | 1.474 |
| Poly(ethylene succinate) | 1.4744 |
| Poly(tetradecyl methacrylate) | 1.4746 |
| Poly(hexadecyl methacrylate) | 1.475 |
| Cellulose acetate butyrate | 1.475 |
| Cellulose acetate | 1.475 |
| Poly(vinyl formate) | 1.4757 |
| Ethylene/vinyl acetate copolymer-40% vinyl acetate | 1.476 |
| Poly(2-fluoroethyl methacrylate) | 1.4768 |
| Poly(octyl methyl silane) | 1.478 |
| Ethyl cellulose | 1.479 |
| Poly(methyl acrylate) | 1.4793 |
| Poly(dicyanopropyl siloxane) | 1.48 |
| Poly(oxymethylene) | 1.48 |
| Poly(sec-butyl methacrylate) | 1.48 |
| Poly(dimethylsiloxane-co-alpha-methyl styrene) | 1.48 |
| Poly(n-hexyl methacrylate) | 1.4813 |
| Ethylene/vinyl acetate copolymer-33% vinyl acetate | 1.482 |
| Poly(n-butyl methacrylate) | 1.483 |
| Poly(ethylidene dimethacrylate) | 1.4831 |
| Poly(2-ethoxyethyl methacrylate) | 1.4833 |
| Poly(n-propyl methacrylate) | 1.484 |
| Poly(ethylene maleate) | 1.484 |
| Ethylene/vinyl acetate copolymer-28% vinyl acetate | 1.4845 |
| Poly(ethyl methacrylate) | 1.485 |
| Poly(vinyl butyral) | 1.485 |
| Poly(vinyl butyral)-11% hydroxyl | 1.485 |
| Poly(3,3,5-trimethylcyclohexyl methacrylate) | 1.485 |
| Poly(2-nitro-2-methylpropyl methacrylate) | 1.4868 |
| Poly(dimethylsiloxane-co-diphenylsiloxane) | 1.488 |
| Poly(1,1-diethylpropyl methacrylate) | 1.4889 |
| Poly(triethylcarbinyl methacrylate) | 1.4889 |
| Poly(methyl methacrylate) | 1.4893 |
| Poly(2-decyl-1,4-butadiene) | 1.4899 |
| Polypropylene, isotactic | 1.49 |
| Poly(vinyl butyral)-19% hydroxyl | 1.49 |
| Poly(mercaptopropyl methyl siloxane) | 1.49 |
| Poly(ethyl glycolate methacrylate) | 1.4903 |
| Poly(3-methylcyclohexyl methacrylate) | 1.4947 |
| Poly(cyclohexyl alpha-ethoxyacrylate) | 1.4969 |
| Methyl cellulose | 1.497 |
| Poly(4-methylcyclohexyl methacrylate) | 1.4975 |
| Poly(decamethylene glycol dimethacrylate) | 1.499 |
| Poly(vinyl alcohol) | 1.5 |
| Poly(vinyl formal) | 1.5 |
| Poly(2-bromo-4-trifluoromethyl styrene) | 1.5 |
| Poly(1,2-butadiene) | 1.5 |
| Poly(sec-butyl alpha-chloroacrylate) | 1.5 |
| Poly(2-heptyl-1,4-butadiene) | 1.5 |
| Poly(vinyl methyl ketone) | 1.5 |
| Poly(ethyl alpha-chloroacrylate) | 1.502 |
| Poly(vinyl formal) | 1.502 |
| Poly(2-isopropyl-1,4-butadiene) | 1.502 |
| Poly(2-methylcyclohexyl methacrylate) | 1.5028 |
| Poly(bornyl methacrylate) | 1.5059 |
| Poly(2-t-butyl-1,4-butadiene) | 1.506 |
| Poly(ethylene glycol dimethacrylate) | 1.5063 |
| Poly(cyclohexyl methacrylate) | 1.5065 |
| Poly(cyclohexanediol-1,4-dimethacrylate) | 1.5067 |
| Butyl rubber (unvulcanized) | 1.508 |
| Gutta percha b | 1.509 |
| Poly(tetrahydrofurfuryl methacrylate) | 1.5096 |

TABLE 1-continued

| Polymer | Refractive Index |
|---|---|
| Poly(isobutylene) | 1.51 |
| Polyethylene, low density | 1.51 |
| Ethylene/methacrylic acid ionomer, sodium ion | 1.51 |
| Polyethylene | 1.51 |
| Cellulose nitrate | 1.51 |
| Polyethylene lonomer | 1.51 |
| Polyacetal | 1.51 |
| Poly(1-methylcyclohexyl methacrylate) | 1.5111 |
| Poly(2-hydroxyethyl methacrylate) | 1.5119 |
| Poly(1-butene) (isotactic) | 1.5125 |
| Poly(vinyl methacrylate) | 1.5129 |
| Poly(vinyl chloroacetate) | 1.513 |
| Poly(N-butyl methacrylamide) | 1.5135 |
| Gutta percha a | 1.514 |
| Poly(2-chloroethyl methacrylate) | 1.517 |
| Poly(methyl alpha-chloroacrylate) | 1.517 |
| Poly(2-diethylaminoethyl methacrylate) | 1.5174 |
| Poly(2-chlorocyclohexyl methacrylate) | 1.5179 |
| Poly(1,4-butadiene) (35% cis; 56% trans; 7% 1,2-content) | 1.518 |
| Poly(acrylonitrile) | 1.5187 |
| Poly(isoprene), cis | 1.5191 |
| Poly(allyl methacrylate) | 1.5196 |

An exemplary submersible target may be made out of a plastic that has a density greater than that of water, or greater than about 0.99823 g/cc at 20 degrees Celsius. Density is defined as the mass per unit volume and specific gravity is the density of a material at a certain temperature divided by the density of water. Therefore, a material with a specific gravity of greater than 1.0 will sink in water. Some plastics and elastomers have a density greater than water, such as fluoropolymers, silicones and urethanes. In some cases, an additive or filler may be added to the polymer that increases the density of the composite material. Table 2 lists some polymers that have a density greater than water.

TABLE 2

| Polymer Name | Min Value ($g/cm^3$) | Max Value ($g/cm^3$) |
|---|---|---|
| ABS - Acrylonitrile Butadiene Styrene | 1.02 | 1.21 |
| ABS Flame Retardant | 1.15 | 1.2 |
| ABS High Heat | 1.1 | 1.15 |
| ABS High Impact | 1 | 1.1 |
| ABS/PC Blend - Acrylonitrile Butadiene Styrene/Polycarbonate Blend | 1.1 | 1.15 |
| ABS/PC Blend 20% Glass Fiber | 1.25 | 1.25 |
| ABS/PC Flame Retardant | 1.17 | 1.19 |
| Amorphous TPI Blend, Ultra-high heat, Chemical Resistant (High Flow) | 1.37 | 1.37 |
| Amorphous TPI Blend, Ultra-high heat, Chemical Resistant (Standard Flow) | 1.37 | 1.37 |
| Amorphous TPI, High Heat, High Flow, Lead-Free Solderable, 30% GF | 1.52 | 1.52 |
| Amorphous TPI, High Heat, High Flow, Transparent, Lead-Free Solderable (High Flow) | 1.31 | 1.31 |
| Amorphous TPI, High Heat, High Flow, Transparent, Lead-Free Solderable (Standard Flow) | 1.31 | 1.31 |
| Amorphous TPI, Highest Heat, Chemical Resistant, 260C UL RTI | 1.42 | 1.42 |
| Amorphous TPI, Moderate Heat, Transparent | 1.3 | 1.3 |
| Amorphous TPI, Moderate Heat, Transparent (Food Contact Approved) | 1.3 | 1.3 |
| Amorphous TPI, Moderate Heat, Transparent (Mold Release grade) | 1.3 | 1.3 |
| Amorphous TPI, Moderate Heat, Transparent (Powder form) | 1.3 | 1.3 |
| ASA - Acrylonitrile Styrene Acrylate | 1.05 | 1.07 |

TABLE 2-continued

| Polymer Name | Min Value ($g/cm^3$) | Max Value ($g/cm^3$) |
|---|---|---|
| ASA/PC Blend - Acrylonitrile Styrene Acrylate/Polycarbonate Blend | 1.15 | 1.15 |
| ASA/PC Flame Retardant | 1.25 | 1.25 |
| ASA/PVC Blend - Acrylonitrile Styrene Acrylate/Polyvinyl Chloride Blend | 1.2 | 1.2 |

A preferred material for the submersible target has a refractive index that is substantially the same as water, or within about 0.25 the index of refraction of water (1.08 to 1.58) and has a density greater than the density of water which is 0.99823 g/cc at 20 degrees Celsius, which causes the submersible target to sink. A material may have a specific gravity that is greater than 1.0, which means the density is greater than that of water, when measured at the same temperature.

An exemplary submersible target may be made out of a polymeric material that is molded into a desired shape. An exemplary polymeric material may be an elastomer, such as a silicone or urethane. An exemplary material for the submersible target a silicone elastomer, Sylgard 184, available from Dow Corning Corporation, which has a refractive index of about 1.4, which is substantially the same as water as defined herein, and a specific gravity of 1.03 g/cc, greater than water. Water has a density of about 0.997 g/cc at 25° C., a typical pool temperature. Another exemplary material that may be used to form the submersible target is a urethane, such as an elastic urethane, Clear Flex 95, available from Smooth-On, Inc, Macungie, PA, which has a specific gravity of 1.04 g/cc and an index of refraction that is substantially the same as water.

An exemplary target may comprise a combination of materials that achieve desired properties of being substantially transparent in water and having a density to cause the submersible target to sing. An exemplary submersible target allows a significant percentage of light to pass therethrough, having a light transmissibility of about 80% or more, about 85% or more, about 90% or more or event 95% or more. The higher the transmissibility, the more light will pass therethrough, thereby enabling features on the bottom of the pool or underneath the submersible target to be visible.

An exemplary submersible target may comprise a thin layer, or covering layer, configured around the outside of the submersible target. This thin covering layer may have an index of refraction that is not substantially the same as water, but may be thin enough to produce a submersible target that is still very difficult to identify when submersed on the bottom of a pool. A thin covering layer may produce less distortion of light passing therethrough. For example, the thin layer, or thin covering layer may have a thickness of about 2 mm or less, about 1.5 mm or less, about 1 mm or less and any range between and including the thicknesses provided. A thin covering layer may form a durable covering or shell that may be hollow or have another material configured therein, such as a material that has an index of refraction that is substantially the same, or effectively the same as water, as defined herein. The combined effect of the layers of materials with varied refractive indexes may produce minimal distortion of light such that it is very difficult to identify the submersible target when submersed in a pool.

An exemplary submersible target or body portion of the submersible target may be made from a hydrogel or comprise a hydrogel, and the hydrogel may be crosslinked include additives, or be made with processing techniques for durability as a pool toy. Some hydrogels have an index of refraction that is effectively the same as that of water, or within about 0.1 the index of refraction of water. Hydrogels may swell with water and this may aid in gameplayers finding the submersible target over time. A hydrogel may be contained within an enclosure, such as a covering layer, for additional durability, such as a thin layer or cover. The covering layer may be made out of an elastic material and may be water permeable, such that the submersible target grows in size when tossed in the pool as the hydrogel swells with water permeating through the covering. A hydrogel absorbs water and may include Heavy water or deuterium oxide.

An exemplary body portion may comprise heavy water, which may be contained within a covering layer. Heavy water (deuterium oxide), is a form of water that contains only deuterium, H or D, also known as heavy hydrogen rather than the common hydrogen-1 isotope, also called protium, that makes up most of the hydrogen in normal water. The presence of the heavier hydrogen isotope gives the water different nuclear properties, and the increase of mass gives it slightly different physical and chemical properties when compared to normal water. Heavy water is not radioactive. In its pure form, it has a density about 11% greater than water, but is otherwise physically and chemically similar.

In addition, a submersible target may produce shadows and these shadows may make detection easier. Therefore, it may be desirable for the submersible target to have a perimeter or shape that produces no easily detected shadows. A submersible target may have a shape that makes it more difficult to locate when submerged in a pool. The shape may be irregular having limited linear portions or edges or continuously curved portions or edges. An exemplary submersible target may have a discontinuous shape including the outer surface, perimeter and edges, wherein these surfaces are undulating and are substantially free of linear segments or smooth curved segments, planar or curved surfaces and/or linear or curved edges. Smooth continuous surfaces may be more easily seen by game players or may cast a shadow having a regular shape or edge that makes it easier to find.

An exemplary submersible target has a body portion with a substantially discontinuous outer surface, wherein the outer surfaces are non-linear or a non-continuous curve. Also, the perimeter and edges of the outer surface may be discontinuous wherein they are non-linear or a non-continuous curve. A preferred outer surface is undulating, having protrusions extending from the surface that break up the surface and make it blend in with the water. Also, the protrusions may project a discontinuous shadow, thereby making the target difficult to find. The protrusions on the outer surface may be rounded protrusions having a radius of curvature of about 0.5 cm to about 2 cm or more. An exemplary submersible target has a discontinuous outer surface, wherein the surface when viewed from any angle has no continuous surface area, planar or a continuous curve, greater than 10 $cm^2$, and preferably no more than 5 $cm^2$. Likewise, a submersible target having a substantially discontinuous perimeter or edge that has a perimeter that is non-linear or follows a non-continuous curve, wherein there are no linear segments or continuous curve segment of more than about 10 cm, and preferably more than 5 cm. The edges of a submersible target may also be discontinuous and may not be orthogonal, but rather undulating and substantially discontinuous as defined for the perimeter.

An exemplary submersible target may have a puck shape, having a generally circular or round shape that a thickness that is less than the diameter. A puck shaped body portion of the submersible target may have a discontinuous outer surface, perimeter and edges. Another exemplary shape is a cylindrical body having a plurality of protrusions such as fins extending therefrom. An exemplary submersible target has a central body portion and a plurality of protrusions such as fins. The fins or protrusions may be configured around the exposed surface of the submersible target when resting on a bottom of the submersible target. The fins may act to break up the surface of the submersible target and scatter light in such a way to make the submersible target blend in with the water and surrounding surfaces. Again, smooth continuous surfaces may be more easily seen by game players. The outer surfaces, as described herein, may include the exposed surfaces when the submersible target is resting on the swimming pool floor.

An exemplary submersible target has rough surfaces, or surfaces having a surface roughness, Ra value, of 0.35 μm or more. This average Ra value is considered a matte finish. An exemplary submersible target may have a fine matte finish or a rougher surface, as described in Table 3. The average Ra surface roughness as determined by Society of Plastic Industry, may be 0.35 μm or more, 0.45 μm or more, 0.63 μm or more, 1.0 μm or more, 3.0 μm or more and any range between and including the values provided.

TABLE 3

| Finish | SPI* standard | Typical surface roughness Ra (μm) |
|---|---|---|
| Super High Glossy finish | A-1 | 0.012 to 0.025 |
| High Glossy finish | A-2 | 0.025 to 0.05 |
| Normal Glossy finish | A-3 | 0.05 to 0.10 |
| Fine Semi-glossy finish | B-1 | 0.05 to 0.10 |
| Medium Semi-glossy finish | B-2 | 0.10 to 0.15 |
| Normal Semi-glossy finish | B-3 | 0.28 to 0.32 |
| Fine Matte finish | C-1 | 0.35 to 0.40 |
| Medium Matte finish | C-2 | 0.45 to 0.55 |
| Normal Matte finish | C-3 | 0.63 to 0.70 |
| Satin Textured finish | D-1 | 0.80 to 1.00 |
| Dull Textured finish | D-2 | 1.00 to 2.80 |
| Rough Textured finish | D-3 | 3.20 to 18.0 |

In some cases, a sinker may be included in the submersible target. A sinker is a material with a density greater than water, such as about 1.2 g/cm3 or more, about 2.0 g/cm3 or more, about 3.0 g/cm3 or more, about 4.0 g/cm3 or more and any range between and including the values provided. A sinker preferably has a refractive index substantially the same as water, as defined herein. Exemplary sinker materials, include glass, dense plastics as provided in Table 2, fluoropolymers, and the like. An exemplary sinker may be configured proximal to or on the bottom surface of the submersible target to cause the submersible target to sink and rest on the bottom of the submersible target. The bottom of the submersible target may be smooth and flat and have no protrusions, where the exposed submersible target may be rough and have a discontinuous outer surface, as described herein. Some metals have a density that is very high and therefore would require less volume to produce an effective sinker. Some very dense metals or metals with a density of more than about 5 g/cm3 include, but are not limited to, tungsten, osmium, platinum, gold, and the like.

An exemplary submersible target may be sized to make it possible to find, but not too large such that it is easy to find. An exemplary submersible target may have no dimension, length, width, height, or diameter of more than about 15 cm and preferably no more than bout 12 cm and at least 2 cm or more, or at least 4 cm, and any range between and including the sizes provided, such as between about 4 cm and about 15 cm. The target should be large enough to prevent it from fitting through screens of the filters in the swimming pool.

An exemplary submersible target further has a detection device, such as a light. The light may be very small, such as less than 1 cm in dimension and may be a light emitting diode (LED). A small battery, such as a button battery, may be used to power the light. A submersible target may have a timer that actives the detection device or light to turn on after an activation time has transpired. The timer may be turned on by an activation button, or the submersible target may have a submersion detector that detects when the submersible target is submerged in water. The detection device timer may be activated by a controller when the submersion detector detects submersion. The light may automatically come on after the expiration of the timer time.

In an exemplary embodiment, the submersible target has a wireless signal receiver configured to receive a wireless signal from a remote electronic device, such as a mobile phone. The controller may pair or synch with the remote electronic device to receive and recognize the wireless signal. A game activator may use the remote electronic device to activate the timer or activate the detection device. For example, one or more of the submersible targets may be tossed in a pool and a game activator may allow the game players to search for a while for the targets. If they cannot find the target or targets, the game activator may use the remote electronic device to turn on a timer or turn on the detection device so the game players can more easily find the submersible targets.

An exemplary submersible target may be configured to be more easily detected of seen when special eyewear or goggles are worn. The body portion may polarize the light and polarized goggles may make it easier to spot. A body portion may include a pigment that produces a non-visible wavelength of light that is detected when viewed through goggles, for example.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
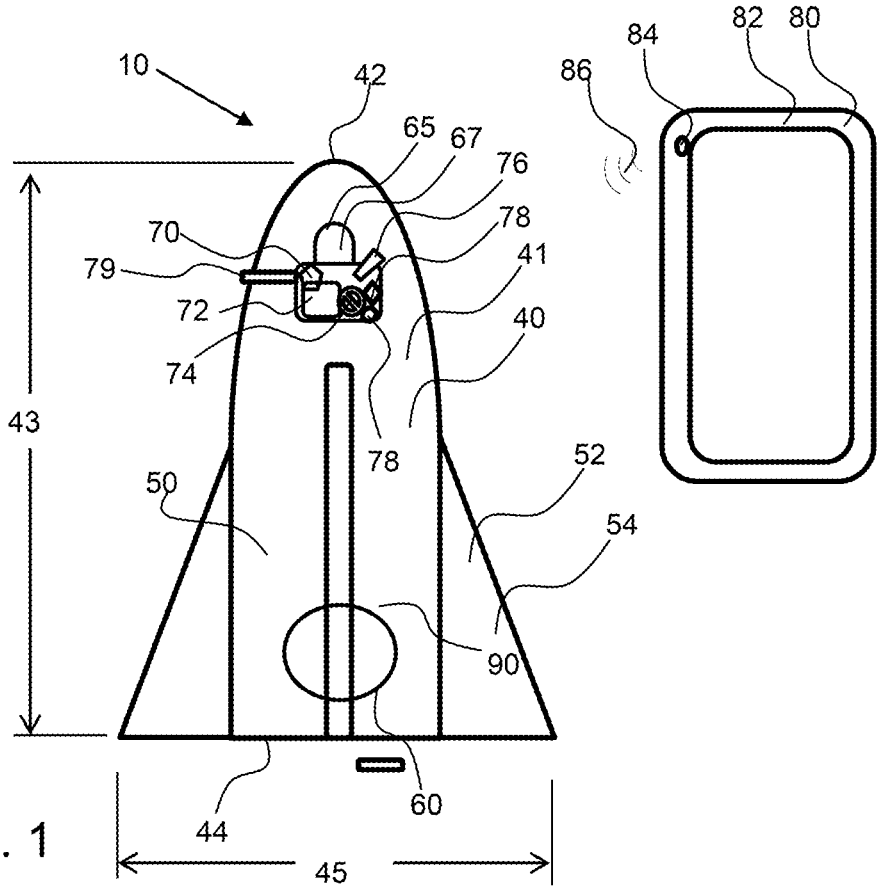
FIG. 1 shows a side view of an exemplary submersible target having a discontinuous body portion, a sinker, a light detection device and a wireless receiver.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
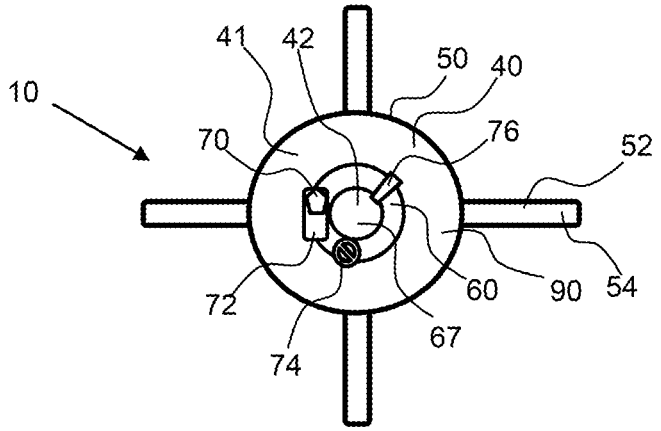
FIG. 2 shows a top view of the exemplary submersible target shown in FIG. 1.

Referring to FIGS. 1 and 2, an exemplary underwater retrieval game system 10, includes a submersible target 40 that has a body portion 41 with a discontinuous outer surface 50 comprises of a plurality of protrusions 52, such as fins 54 as shown. The discontinuous outer surface may make is more difficult for a game player to locate the submersible target, as described herein. Also, the discontinuous outer surface 50 may be effectively rough, wherein there is no smooth surface over an area of 5 $cm^2$ or more, as defined herein. Also, the body portion and protrusions, such as fins, may be made out of a material that has an index of refraction that is substantially the same as water, or no more than about 1.5 and no less than about 1.2. The body portion and/or the protrusions may be an elastomeric material that is translucent and may have an effective density cause the submersible target to sink in water. The body portion has a height 43 from the bottom 44 to the top 42 and a width 45 of the widest part of the body portion extending orthogonally from the height. Note that a width may be a diameter of the body portion.

The exemplary submersible target also has a sinker 60, that may be configured within the body portion to aid in sinking the submersible target to the bottom surface of a pool. A sinker may have a density greater than 1.0 g/cc to that will cause the submersible target to sink in water. As described herein the sinker may be made out of material that has an index of refraction that is substantially the same as water, or no more than about 1.5 and no less than about 1.2, such as glass. Also, the sinker may be effectively transparent. As shown, the sinker may be configured proximal to the bottom 44 of the body portion 41 of the submersible target 40. The location of the sinker may be configured to cause the submersible target to sink and rest on the bottom 38 of the pool 30, as shown in FIGS. 3 and 4.

The exemplary submersible target has a detection device 65, such as a light 67. The light may be very small, such as a LED light, to prevent easy detection of the submersible target when underwater. The light may be configured to turn on after a period of time after submersion in water which may be determined by the timer 74. A controller 70 may activate the light to turn on after a set time from submersion, as detected by the submersion detector 78. Alternatively, the timer may be activated by an activation button 79. A user may activate the time and toss the submersible target into the pool and the light will automatically turn after the set time has expired. A small battery 72, such as a button battery, may be used to power the controller, detection device and the like.

As exemplary submersible target may be configured with a wireless signal receiver 76, wherein the detection device 65, such as the light 67, may be activated by remote electronic device 80, such as a mobile phone 82. The remote electronic device 80 may send a wireless signal 86 from a transmitter 84 that activates the detection device to turn on. The controller 70 may control the functions of the detection device and may include a microprocessor.

Figure 3:
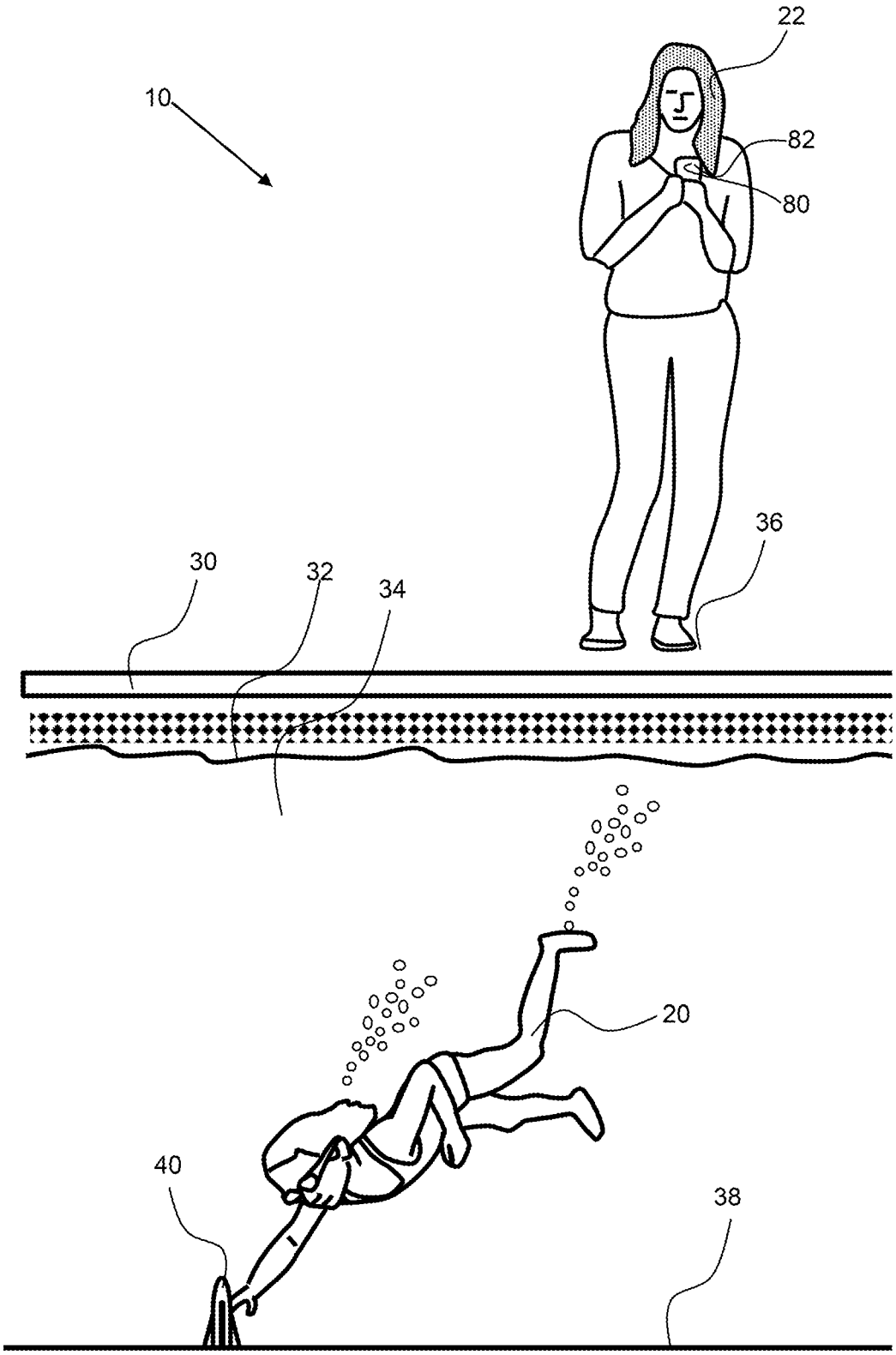
FIG. 3 shows a side view of a child game player retrieving a submersible target from the bottom surface of a pool.
Figure 4:
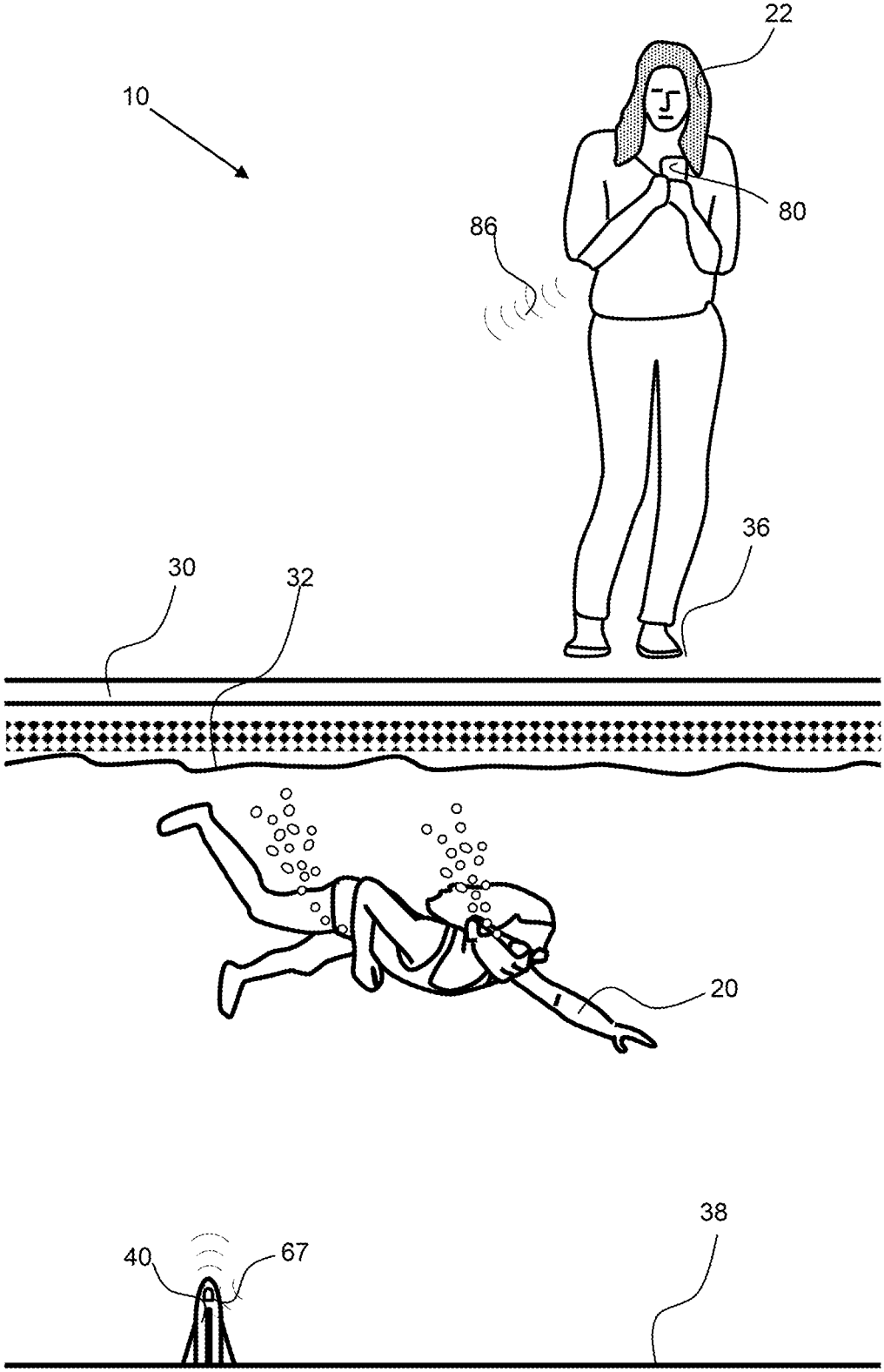
FIG. 4 shows a side view of a game activator on the deck of the pool activating a light detection device to help the child game player find the submersible target.

Referring now to FIGS. 3 and 4, the exemplary submersible target is shown without all the references as shown in FIGS. 1 and 2, or FIGS. 5-7. As shown in FIG. 3, a game player 20, a child, is diving down into the water 34 of a pool 30 to retrieve the submersible target 40. The target is below the water level 32 and is resting on the bottom 38 or bottom surface of the pool. A parent or game activator 22 is standing on the deck 36 of the pool. The parent has a remote electronic device 80, such as a mobile phone 82 that may activate a game detection device.

As shown in FIG. 4, the game activator 22 has activated the detection device, the light 67 to come on. The game activator 22 interfaced with the remote electronic device 80 to produce a wireless signal 86 that is recognized by the controller when received by the receiver. The child is swimming away from the submersible target and therefore the game activator as activated the detection device to make it easier to locate.

Figure 5:
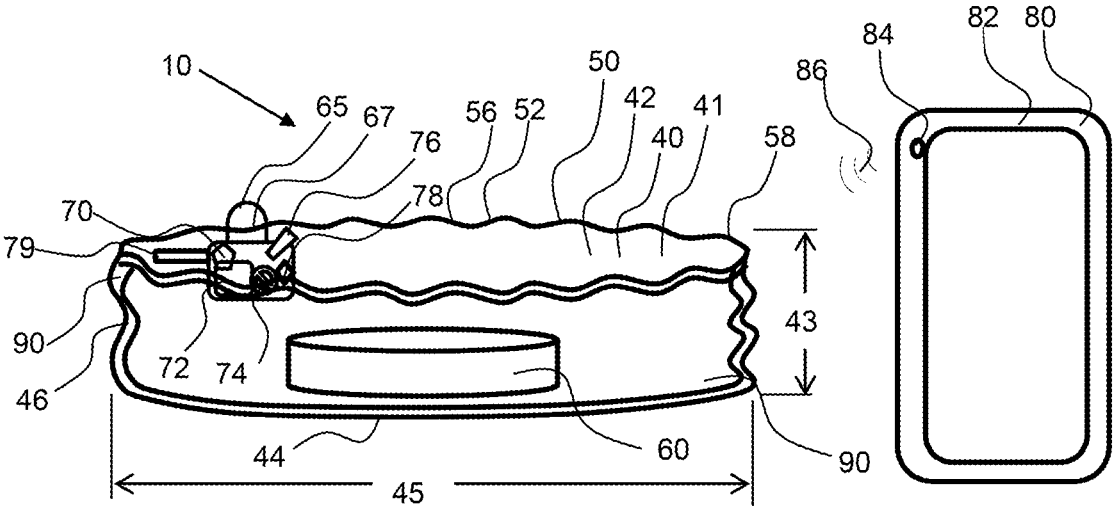
FIG. 5 shows a perspective view of an exemplary submersible target having a discontinuous body portion, a sinker, a light detection device and a wireless receiver.
Figure 6:
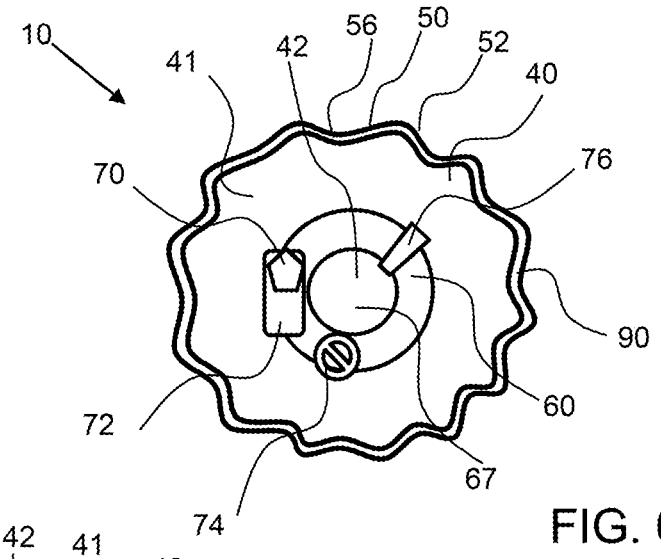
FIG. 6 shows a top view of the exemplary submersible target shown in FIG. 5.
Figure 7:
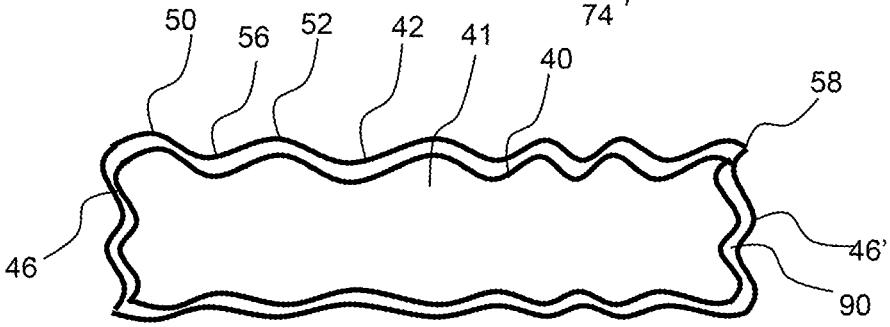
FIG. 7 shows a side cross-sectional view of the submersible target shown in FIG. 5.

Referring now to FIGS. 5 to 7, the exemplary submersible target 40 has a discontinuous outer surface, wherein the discontinuous outer surfaces 50 are not planar or a continuous curved surface. Rather, the surfaces are undulating or wavy having a plurality of protrusions 52 that project a shadow that is also wavy and discontinuous, thereby making the submersible target very difficult to find when submersed in a pool. The discontinuous outer surface may have no area greater then 5 $cm^2$ that is planar or follows a smooth curve. The coin shaped submersible target forms a perimeter that is also a substantially discontinuous perimeter 56, wherein when viewed from any angle, the perimeter is substantially non-linear or follows a continuous curve. As shown, the perimeter is undulating and irregular, whereby the undulations are not regular. Also, the edges, or the area between surfaces, such as the top surface 42 and the side surfaces 46, are substantially discontinuous edges 58, whereby they are non-linear or follow a continuous curve. Again, the edges are undulating and irregular, whereby the undulations along the edges are not regular in pattern. Again, the shadows produced by this submersible target would make the target very difficult to find when submersed in a pool.

The exemplary coin shaped submersible target has a cover layer 90 that may be made out of a different material that a material contained within the cover layer. As described herein the cover layer may be thin, such as less than 2 mm and may have an index of refraction that is substantially the same as water. The cover layer and an interior material may have indexes of refraction that are different, by as much as about 0.1 more, about or 0.2, about 0.3 or more, or even about 0.4 or more. This difference in index of refraction may distort the light passing through the submersible target, making it difficult to identify or locate when submersed in a pool.

The exemplary coin shaped submersible target has a detection device 65, such as a light 67. The light may be very small, such as a LED light, to prevent easy detection of the submersible target when underwater. The light may be configured to turn on after a period of time after submersion in water which may be determined by the timer 74. A controller 70, such as a microprocessor, may activate the light to turn on after a set time from submersion, as detected by the submersion detector 78. Alternatively, the timer may be activated by an activation button 79. A user may activate the time and toss the submersible target into the pool and the light will automatically turn after the set time has expired.

As exemplary submersible target may be configured with a wireless signal receiver 76, wherein the detection device 65, such as the light 67, may be activated by remote electronic device 80, such as a mobile phone 82. The remote electronic device 80 may send a wireless signal 86 from a transmitter 84 that activates the detection device to turn on. The controller 70 may control the functions of the detection device and may include a microprocessor.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A submersible target retrieval game method comprising:

a) providing a submersible target comprising:

i) a body portion that is substantially transparent in water being made of a material having an index of refraction of no more than 1.5 and no less than 1.2;

wherein the submersible target has a density of 1.0 g/cc or more;

wherein the body portion is a polymeric material;

b) placing the submersible target in water contained within a pool;

c) allowing the submersible target to sink in said water to a bottom of the pool; and d) swimming in said pool and locating the submersible target and retrieving the submersible target; and wherein the submersible target has a top and side surfaces when resting on a bottom of a pool and wherein said top and side surfaces are discontinuous outer surfaces having no continuous surface area greater than 5 cm2 with a surface roughness of less than 0.35 μm Ra;

wherein the body portion has a substantially discontinuous perimeter having no linear segments or continuous curve segment of more than about 10 cm in length; and wherein the discontinuous perimeter comprises edges between surfaces and wherein the edges are substantially discontinuous edges having no linear segments or continuous curve segment of more than about 10 cm in length;

whereby the discontinuous outer surfaces, the substantially discontinuous perimeter with substantially discontinuous edges produce an irregular shadow on said bottom of said pool when the submersible target is resting on said bottom of said pool to make said submersible target difficult to locate.

2. The submersible target retrieval game method of claim 1, wherein the submersible target consists of a polymeric material.

3. The submersible target retrieval game method of claim 1, wherein the body portion is an elastomeric material.

4. The submersible target retrieval game method of claim 1, wherein the submersible target consists of an elastomeric material.

5. The submersible target retrieval game method of claim 1, wherein the body portion has a density greater than 1.0 g/cc to cause the target to sink in said water.

6. The submersible target retrieval game method of claim 1, wherein the submersible target further comprises a sinker having a density greater than 1.2 $g/cm^3$ and an index of refraction of no more than 1.5 and no less than 1.2.

7. The submersible target retrieval game method of claim 6, wherein the sinker comprises glass.

8. The submersible target retrieval game method of claim 6, wherein the sinker is no more than 25% of the submersible target by volume.

9. The submersible target retrieval game method of claim 8, wherein the body portion consists of a polymeric material.

10. The submersible target retrieval game method of claim 1, wherein the body portion comprises a plurality of protrusions extending from the body portion.

11. The submersible target retrieval game method of claim 10, wherein the plurality of protrusions are fins that extends outward from the body portion.

12. The submersible target retrieval game method of claim 11, wherein the body portion is cylindrical in shape.

13. The submersible target retrieval game method of claim 1, wherein the submersible target further comprises a light detection device.

14. The submersible target retrieval game method of claim 13, wherein the submersible target comprises a controller and a timer, and wherein the detection device is automatically activated after a period of time determined by the timer.

15. The submersible target retrieval game method of claim 1, further comprising a covering layer configured around the body portion and having a thickness of 2 mm and a refractive index between 1.08 to 1.58.

16. The submersible target retrieval game method of claim 15, wherein the body portion comprises a hydrogel.

17. The submersible target retrieval game method of claim 15, wherein the body portion comprises deuterium oxide.

* * * * *